US005714964A

United States Patent [19]

Jackson

[11] Patent Number: 5,714,964

[45] Date of Patent: Feb. 3, 1998

[54] HORNED INTERFEROMETER ANTENNA APPARATUS

[75] Inventor: Paul K. W. Jackson, Oakton, Va.

[73] Assignee: Condor Systems, Inc., San Jose, Calif.

[21] Appl. No.: 554,481

[22] Filed: Nov. 7, 1995

[51] Int. Cl.[6] ..... H01Q 21/00

[52] U.S. Cl. ..... 343/786; 343/853; 342/156

[58] Field of Search ..... 343/786, 772, 343/773, 774, 853, 850, 858; 342/156, 362; H01Q 21/00

[56] References Cited

U.S. PATENT DOCUMENTS

| | | | |
|---|---|---|---|
| 2,283,935 | 5/1942 | King | 343/786 |
| 2,438,987 | 4/1948 | Bailey | 343/786 |
| 2,615,132 | 10/1952 | Rumsey | 343/786 |
| 3,068,478 | 12/1962 | Hagaman | 343/786 |
| 3,775,773 | 11/1973 | Nemit | 343/786 |
| 4,349,827 | 9/1982 | Bixler et al. | 343/786 |

OTHER PUBLICATIONS

Paul Eyring, "Monopulse DF Antenna for Submarine ESM Applications," *Association of Old Crows Symposium Digest*, Sep., 1995.

Paul Eyring and Randolph Clapp, "Design and Development of Wide–Band Circular Array Interferometers," Proceeding of the 1994 Antennas Application Symposium, p. 8/1–35 no month.

*Primary Examiner*—Hoanganh T. Le
*Attorney, Agent, or Firm*—J. Michael Johnson

[57] ABSTRACT

A horned interferometer antenna apparatus has parallel plates spaced apart and rigidly connected together by a separator. In the space between the parallel plates is a plurality of antenna elements. The parallel plates each have a free edge which diverge from the other free edge defining an aperture for receiving electromagnetic waves. The horned interferometer antenna apparatus has enhanced directivity and is used for passive radio direction finding. An interferometer system comprises a horned interferometer antenna apparatus, a multi channel receiver and a phase comparator. The interferometer system measures the angle of arrival of an incident electromagnetic wave or signal based on the phase difference between the signal as received by the antenna elements of the horned interferometer antenna apparatus.

11 Claims, 8 Drawing Sheets

HORNED INTERFEROMETER ANTENNA APPARATUS

BACKGROUND OF THE INVENTION

1. Field of the Invention

The present invention relates to radio frequency and microwave interferometer systems for the passive determination of angle of arrival of electromagnetic waves.

2. Description of the Related Art

Passive radio direction finding (DF) entails the determination of the angle of arrival (AOA) of a radio signal or electromagnetic wavefront transmitted from a distant signal source without the cooperation of the transmitting signal source and without actively transmitting a locally generated signal. Knowledge of AOA can be used to locate signal sources for military or other intelligence collection purposes or for improving the signal to noise ratio of the received signals through the use of an adaptive noise cancellation scheme. A widely used apparatus for precision passive AOA determination is the interferometer. An interferometer is a signal receiving and processing system comprising a sensor and a receiver/processor that exploits the differential phase delay between signals received by several sensors to estimate AOA. In radio direction finding the sensors are antennas.

An interferometer sensor or antenna arrangement, also referred to as an antenna array, is comprised of a plurality of antennas arranged in such a manner that a differential phase delay dependent on the AOA is introduced in the received signal as measured at a plurality of output ports of the array. The simplest interferometer sensor or antenna arrangement consists of a pair of antennas, also referred to as antenna elements, positioned along a baseline. A baseline for a two element array is a line that passes through the elements.

A two antenna element, interferometer configuration is illustrated in FIG. 1. In FIG. 1, two antenna elements 1, 2 are positioned along a baseline 3. The antenna elements are separated by a distance D. An incident signal represented by a wavefront 4, is illustrated approaching from an angle of $\phi$ degrees relative to the perpendicular of the baseline 3. The AOA of the signal illustrated in FIG. 1 is defined to be $\phi$ degrees. A propagating electromagnetic wave, originating at a distant source, is well approximated by a plane wave and propagates in a direction, indicated by the wavy line 5, that is perpendicular to its wavefront. This plane wave propagation results in the introduction of an AOA dependent time delay being between the signal as intercepted by the two antennas 1, 2. The time delay, in turn, results in an AOA phase difference between the signal as received by the two antennas. The phase difference $\Delta\psi$ in an ideal two antenna element array is related to the AOA, $\phi$, by equation (1).

$$\phi = \arcsin\left(\frac{\Delta\psi \cdot \lambda}{2 \cdot \pi \cdot D}\right) \tag{1}$$

In equation (1), D is the separation between the antennas 1 and 2 along the baseline 3, and $\lambda$ is the wavelength of the incident electromagnetic wavefront 4. Equivalent expressions to (1) have been derived for arrays of more than two elements.

Equation (1) explicitly assumes that the phase difference, $\Delta\psi$, between the received signals is entirely due to the intercept time delay. Equation (1) does not account for differential phase biases that may exist in the two antennas or that may result from a large angle dependent differential gain in the antennas. The design of interferometers involves the selection of antenna elements that have broad antenna beam patterns in the plane in which AOA is to be measured to avoid potential phase biases thereby making equation (1) valid. Biases that are stationary, biases that do not change with time, can be either accounted for by modifying equation (1) to account for these biases or through calibration. These biases are normally considered sources of error in the AOA determination and are to be avoided as much as is practical during design and manufacture. An ideal antenna element for use in an interferometer array has a constant level of directivity and no phase variation over all angles from which a signal may arrive in the plane in which AOA is to be measured.

The directivity of an antenna or antenna element is defined as the ratio of the power received from a given direction to the total power received from all directions. As such, directivity is a measure of the antennas ability to collect and concentrate incident radiation from signals arriving from a given direction. Directivity is normally reported in units of decibels relative to isotropic (dBi) where isotropic refers to a theoretical antenna having equal directivity in all directions in elevation and azimuth. Real antennas cannot be completely isotropic and, therefore, typically have a maximum directivity in a given direction and angular regions around the maximum where the directivity is higher than that in most other directions. These regions of higher than average directivity surrounding a peak directivity as delineated by specific angular ranges are referred to as the antenna's beamwidth. An angular range in which the directivity has decreased by 3 dB from its peak value is defined as the 3 dB beamwidth. A plot of the directivity vs. angle is called the antenna radiation pattern.

While a two element interferometer can be used to measure AOA in any plane containing the baseline, the assumption will be made hereinafter, for simplicity, that AOA is being determined in a horizontal plane referred to hereinafter as azimuth. A plane perpendicular to the horizontal plane hereinafter will be referred to as vertical or elevation plane.

As mentioned, it is desirable for the antennas elements of an interferometer array to exhibit broad beamwidth with little or no phase variation across the beamwidth, at least in the azimuth plane. Simple, electrically small antennas are generally the best candidates for use in interferometer arrays. Among the known simple elements are monopoles, dipoles and small loops.

Vertically oriented monopoles have uniform, omni-directional directivity in the azimuthal, or horizontal plane. Typically, monopoles are used in conjunction with a ground plane. A monopole on a ground plane consists of a conducting wire or rod mounted perpendicular to a large flat conducting sheet. The wire in a monopole antenna is typically connected to the center conductor of a coaxial transmission line. An electromagnetic field incident on the monopole excites currents in the wire that, in turn, create a propagating signal in the connected transmission line.

The antenna radiation pattern of a monopole has a maximum at or near the horizontal plane and a null in the vertical direction exhibiting a roughly cosinusoidal shape in elevation and a constant level or omni-directional pattern in azimuth. The 3 dB beamwidth, of a monopole is 360 degrees in azimuth and approximately 100 degrees in elevation. An ideal monopole on an infinite ground plane has a maximum directivity of approximately 5.16 dBi for a vertically polarized incident wave. Practical, realizable monopoles exhibit somewhat less directivity due to truncation of the ground plane and other factors.

Dipoles, which can be viewed as a pair of monopoles mounted back to back on the same axis and without the ground plane have very similar characteristics to the monopole but only provide 2.1 dBi directivity. Nevertheless, dipoles are also used as antenna elements in interferometers. Both monopoles and dipoles are relatively broadband antennas having operational frequency ranges typically in excess of an octave. An octave is defined herein as a frequency range in which the upper limit is twice that of the lower limit. The angular variation of received signal phase measured relative the received phase at peak directivity is typically very small in the azimuth plane for vertically mounted single monopoles and dipoles. The combination of constant directivity and a flat phase characteristic in azimuth make dipoles and monopoles ideal for interferometer applications.

A drawback to using monopoles and dipoles as elements for interferometer applications is that they have relatively low peak directivity. In addition, monopoles and dipoles provide no inherent means for increasing or controlling their directivity. Since the ability to detect a weak signal is directly related to the antenna directivity, it is often desirable to use antenna elements in interferometers with higher directivity than that provided by monopoles and dipoles alone.

In interferometer applications where peak directivity is important, vertically oriented E or H plane sectoral horns have often been used. A vertically oriented sectoral horn is a rectangular horn antenna in which the vertical extent of the aperture is much greater than its horizontal extent. An E plane sectoral horn is a sectoral horn in which the E field of the dominant, $TE_{10}$, waveguide mode of the attached rectangular wave guide is aligned with the direction of the larger aperture dimension. An H plane sectoral horn is a sectoral horn in which the H field of the dominant, $TE_{10}$, mode of the attached rectangular wave guide is aligned with the direction of the larger aperture dimension. Both E and H plane vertical sectoral horns provide broad azimuth patterns suitable for use in an interferometer. The increased vertical extent of the aperture of these sectoral horns results in a relatively narrow elevation beamwidth and a corresponding increased directivity for reception of vertically polarized incident waves for E-plane sectoral horns and horizontally polarized incident waves for H-plane sectoral horns.

A drawback to the use of sectoral horns is their relatively narrow operating frequency. Sectoral horns are normally constrained to operate in a frequency range between the cut-off frequencies of the $TE_{10}$ and that of the next higher waveguide mode of the attached rectangular transmission line. This frequency range limitation often falls short of the operational requirements imposed by interferometer applications. They are also relatively heavy and more costly to manufacture than comparable monopoles and dipoles.

Therefore, it would be desirable to have antenna that combines the higher, controllable, directivity of the sectoral horn antenna with broadband operational capability and low manufacturing cost of the monopoles and dipoles. Such an antenna would overcome the shortcomings in interferometer antennas of the prior art.

SUMMARY OF THE INVENTION

The present invention solves this long standing problem in the art by providing an antenna array apparatus for interferometer applications that combines the beneficial high directivity characteristics of the sectoral horn with the well-behaved phase and broad operational frequency bandwidth characteristics of monopoles and dipoles. The apparatus of the present invention is a horned interferometer antenna with good phase characteristics that has unexpectedly accurate AOA determinations and higher directivity in all azimuth receive directions than are possible with monopoles, dipoles, or sectoral horns alone, thereby promoting high fidelity reception of weak signals.

The apparatus of the present invention is a multi-port antenna for determining angle of arrival (AOA) of an incident electromagnetic (EM) wave. The horned interferometer antenna of the present invention unexpectedly exhibits acceptably low phase variation with angle and increased gain compared to traditional low phase variation interferometer antennas such as monopoles. The horned interferometer antenna comprises a parallel plate, waveguide structure situated around a plurality of receiving antenna elements. The waveguide structure further comprises a non-parallel, tapered region at the periphery of the parallel plates that effectively increases the aperture of the antenna, thereby increasing the directivity of the antenna. The increased directivity advantageously and unexpectedly provides improved sensitivity for weak signal detection to the interferometer. A transmission line such as coaxial cable is connected to each of the antenna elements to serve as output ports carrying the received signals away from the antenna and to a suitable interferometer receiver/processor.

Any number of antenna elements greater than one may be located between the top and bottom plate of the horned interferometer antenna. In the case when only two elements are used, the phase difference, $\Delta\psi$, between the received waves in the transmission lines is related to the angle of arrival, $\phi$, by the standard interferometer equation (1) above. Interferometer equations for more than two elements which are well known in the art depend on the configuration of the elements (linear array vs. non-linear array).

The horned interferometer antenna of the present invention is used in a multi-channel interferometer system to measure the angle of arrival of an incident electromagnetic wave or signal based on the phase difference between the signal as received by the antenna elements.

These and other features and advantages of the present invention will be apparent from the following more detailed description of the preferred embodiment, taken in conjunction with the accompanying drawings, which illustrate, by way of example, the principles of the present invention.

BRIEF DESCRIPTION OF THE DRAWINGS

Further details are explained below with the help of the examples illustrated in the attached drawings in which.

DETAILED DESCRIPTION OF THE PREFERRED EMBODIMENTS

Figure 1:
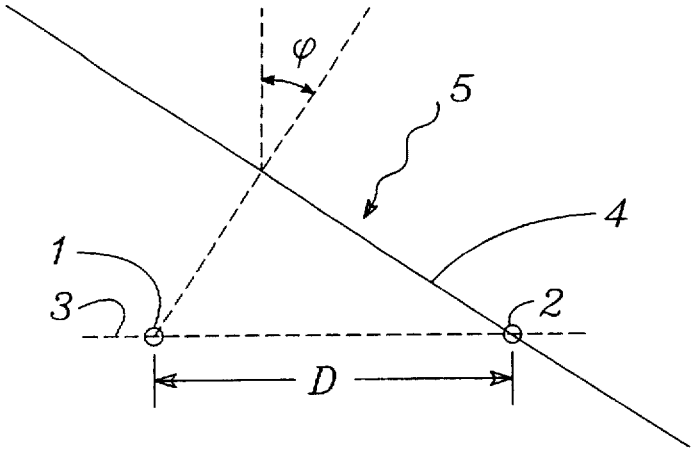
FIG. 1 illustrates a classical interferometer antenna pair showing the orientation between the incident wavefront and the antenna pair resulting in an angle of arrival dependent phase variation in the received outputs.
Figure 2:
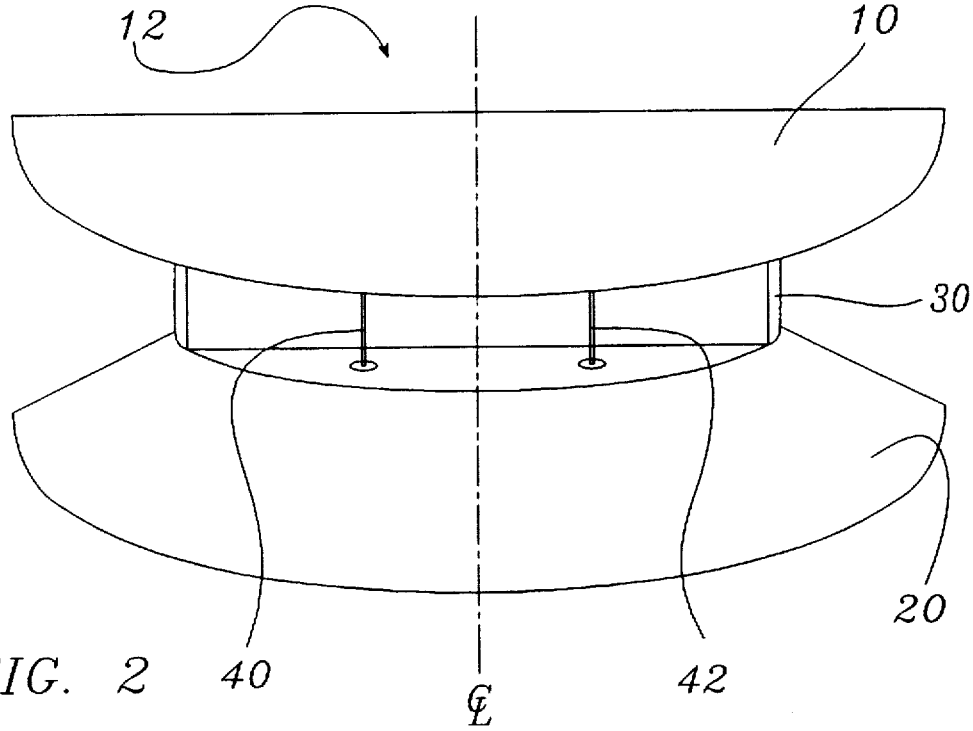
FIG. 2 illustrates a perspective view of a horned interferometer antenna according to one embodiment of the present invention as viewed from in front of and slightly above the antenna.
Figure 3:
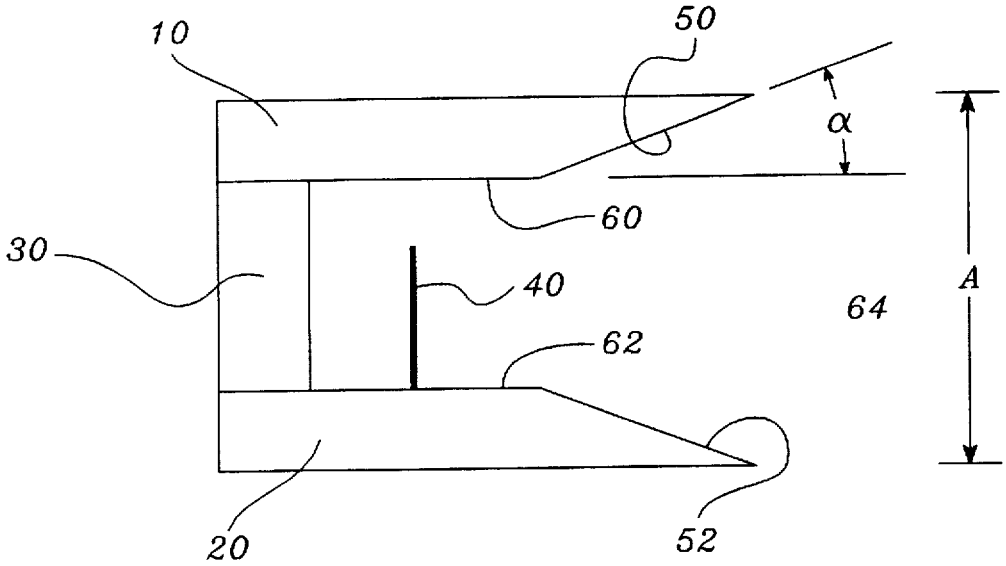
FIG. 3 is a side view of the horned interferometer antenna of FIG. 2.
Figure 4:
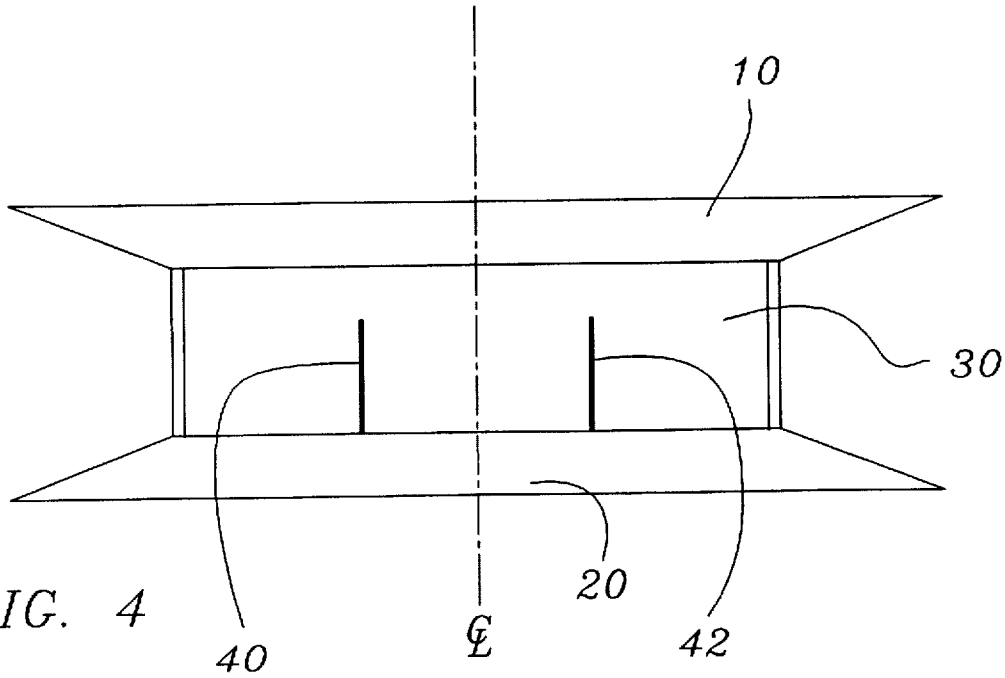
FIG. 4 is a front view of the horned interferometer antenna of FIG. 2 showing the location of the antenna elements of this embodiment.

The horned interferometer antenna 12 of the present invention illustrated in FIGS. 2–4 has a top flanged plate 10 oriented above and parallel to a bottom flanged plate 20 with a fixed separation distance. A separator 30 connects the top plate 10 to the bottom plate 20 and maintains the fixed separation distance. Antenna elements 40, 42 are positioned between the top plate 10 and the bottom plate 20 in front of the separator 30. While only two antenna elements 40, 42 are shown, additional antenna elements may be included in accordance with the invention. Elements 40, 42 are connected via suitable transmission lines, such as coaxial lines to output terminals not shown.

The top and bottom plates 10, 20 are preferably fabricated from an electrically conductive material such as but not limited to aluminum, steel, or copper, or from a suitable structurally rigid material with a conductive sheathing such as but not limited to fiberglass or plastic coated with copper, silver, gold, or aluminum that may be electro-deposited thereon, for example. The plates 10, 20, are generally semi-circular in shape when viewed from above or below and have tapered flanges 50, 52, along the edge of the curved portion of the semi-circle as illustrated in FIG. 3. The semi-circular shape of the preferred embodiment results in a horned interferometer antenna with an angular reception range of between 140 and 180 degrees in azimuth. The plates 10, 20 need not be semi-circular and can range from completely circular to nearly rectangular in accordance with the invention. When circular, a horned interferometer antenna with as much as 360 degrees of azimuthal coverage is realized. Generally speaking, coverage of angles greater than 140–160 degrees requires the use of more than two antenna elements to avoid AOA ambiguities due to the $2\pi$ periodicity of the phase difference $\Delta\psi$ in equation (1).

With reference to FIG. 3, the spacing between the untapered region 60 of the top plate 10 in the vicinity of the antenna elements, 40 and 42, and the untapered region 62 of the bottom plate 20 is preferably less than ½ wavelength at the highest frequency of operation. This spacing ensures that only the dominant, TEM, parallel plate waveguide mode will propagate in this region and thereby be coupled into the antenna elements. The antenna elements, 40 and 42, of the preferred embodiment are based on ¼ wavelength monopoles with the bottom plate 20 acting as a ground plane. The top plate 10, depending on its spacing from the bottom plate 20 and, consequently from the top of the monopoles, 40 and 42, may introduce significant capacitive loading of the monopoles requiring that the monopoles be shortened somewhat to achieve proper resonance conditions. The exact length of the monopole elements, 40 and 42, is determined empirically through a tuning procedure after assembly. Tuning consists of measuring the reflection coefficient of the input port of the antenna element using techniques well known in the art and adjusting the length of the element or the spacing between the plates 10, 20 until the reflection coefficient is below an acceptable value specified by the user. In some cases, with some plate separations and with some element types, it may be found that the best match is obtained by electrically shorting the element to the top plate 10.

The separator 30 can be a single piece, as illustrated in the figures, or can be comprised of a plurality of vertically oriented posts. The separator 30 functions to rigidly connect the top and bottom plates 10, 20 and maintain their relative orientations. Alternatively, the separator 30 can fill the entire space between the top and bottom plate, 10 and 20 completely surrounding and even encapsulating the antenna elements.

The separator 30 is comprised of either a conductive or a non-conductive material depending on its location relative to the antenna elements. When the separator or a portion thereof must be located in front of any of the antenna elements, a non-conductive material, such as polystyrene or Teflon, that is transparent to EM waves must be used.

The term "in front of" herein refers to being positioned between the antenna element and a distant source that is within the field of view of the element.

Figure 5:
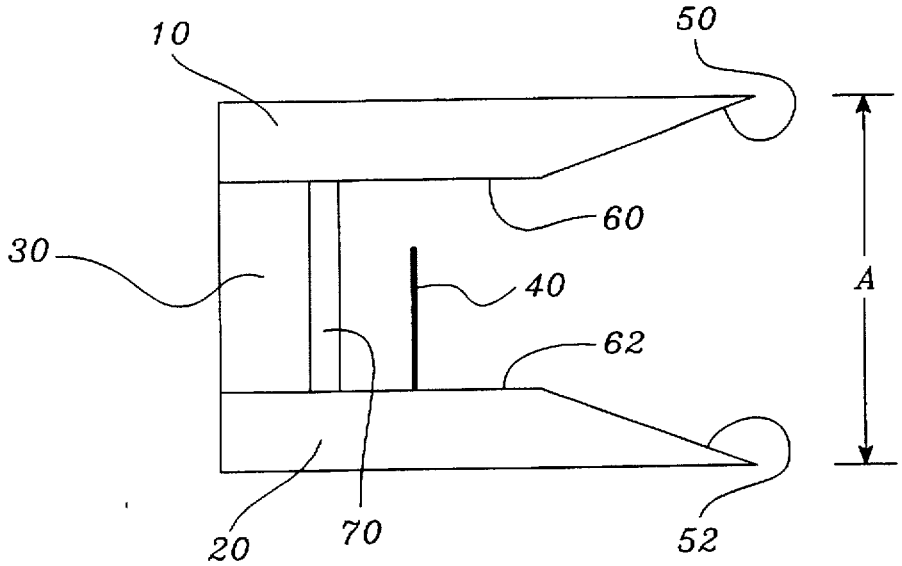
FIG. 5 illustrates the horned interferometer antenna of FIG. 3 with the addition of a microwave absorbing layer between the monopole antenna elements and the separator.

When separator 30 is not in front of the antenna elements a conductive or nonconductive material may be used. If a conductive or high dielectric constant material is used, the separator 30 should be adequately spaced away from the antenna elements 40, 42 to minimize its effect on the elements. Spacing of greater than ½ wavelength at the center frequency of operation is found to be adequate in many situations. In addition, the separator 30 can also be constructed from a combination of materials, such as a conductive material with a microwave absorbing material layer 70 attached to the separator's 30 surface closest to the antenna 40, 42 elements, as illustrated in FIG. 5. The use of a microwave absorbing material layer 70 reduces the effect that the spacing between the antenna element and the separator has on the antenna performance, thereby improving the bandwidth of the interferometer antenna.

The aperture of the horned interferometer antenna 12 is the open area between the outer most edges of the tapered flanges 50 and 52 and is illustrated as having a size A in FIG. 3. According to the present invention, the aperture size A controls the directivity exhibited by the horned interferometer antenna 12. A larger aperture A results in a higher peak directivity and a concomitant narrower elevation beamwidth. Azimuthal beamwidth is unaffected by the aperture size A.

The flange regions 50, 52 of the conducting top 10 and bottom 20 plates also illustrated in FIG. 3, 4 and 5, gradually diverge from one and other as the distance from the antenna elements increases. This provides a smooth transition for the propagating EM wave from the parallel plate waveguide region 60, 62 to the free space region 64. While a wide range of divergence angles, α, illustrated in FIG. 3, can be used, they should preferably be between 10 to 30 degrees. Divergence angles up to 90 degrees and down to much less than 1 degrees are contemplated by the invention. The preferred embodiment has a flange angle of θ=14.84 degrees.

Figure 6:
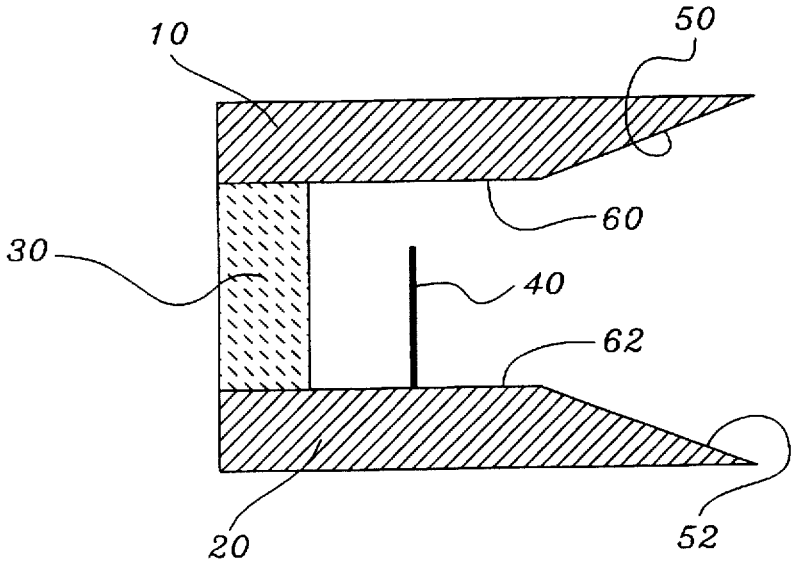
FIG. 6 illustrates in cross-section tapered flanges of the top and bottom plates of the horned interferometer antenna of FIG. 3.
Figure 7:
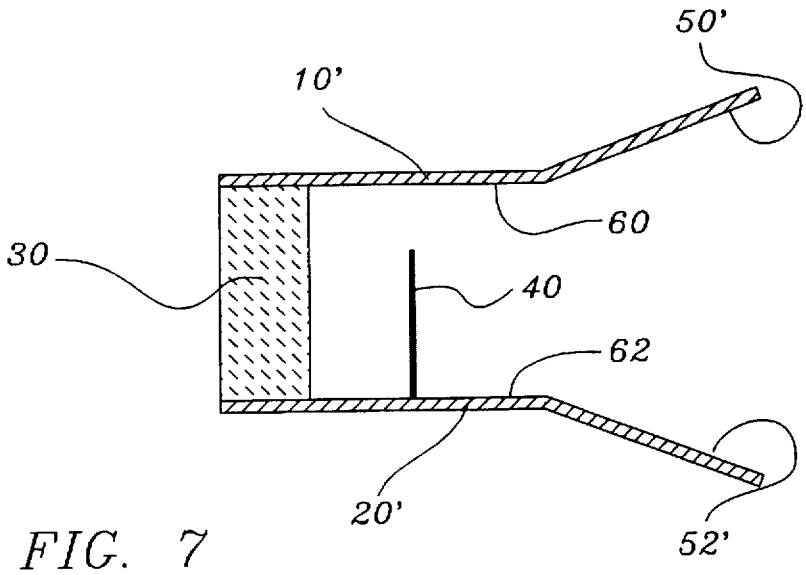
FIG. 7 illustrates in cross-section an embodiment of the horned interferometer antenna that is constructed from a pair of thin plates.
Figure 8:
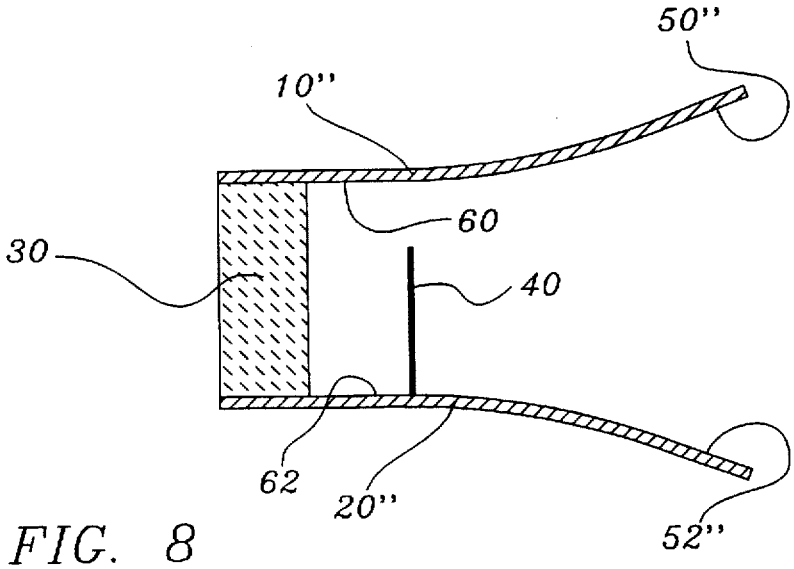
FIG. 8 illustrates in cross-section another embodiment of the horned interferometer antenna with flanges having a non-linear taper.

The shape of the tapered flange surfaces 50, 52 can also be varied and the method of realizing the top 10 and bottom 20 plate can take many forms. FIGS. 5, 6 and 7 illustrate several embodiments of the flange regions of the top and bottom plates 10, 20, of the present invention. FIG. 6 illustrates an embodiment wherein the linear tapered flanges 50, 52 are realized by machining or molding a chamfer into a pair of thick conductive plates 10, 20. This is the method chosen for the preferred embodiment of the present invention. The embodiment in FIG. 7 illustrates a linear tapered flange pair 50', 52' that are constructed from two relatively thin, bent plates 10', 20'. In FIG. 8, a nonlinear tapered flange regions 50" and 52" are illustrated. The non-linear taper of the flanges 50", 52" of FIG. 8 can be any non-linear function of distance along the flange including but not limited to exponential or logarithmic functions. Numerous other materials and methods of manufacturing the tapered flanges are possible and it is not the intent of the inventor to limit the scope of the present invention to those described herein. For example, metal or metalized plastics that are molded to form the desired shapes may be used.

Figure 4A:
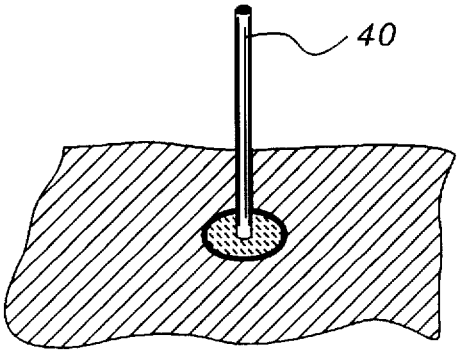
FIGS. 4*a*–4*d* are exploded views of the antenna element of FIG. 4 illustrating the monopole, dipole, loop antenna and microstrip patch antenna elements, respectively, of the present invention.
Figure 4B:
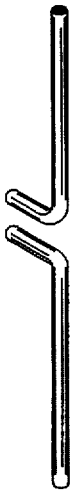
Figure 4C:
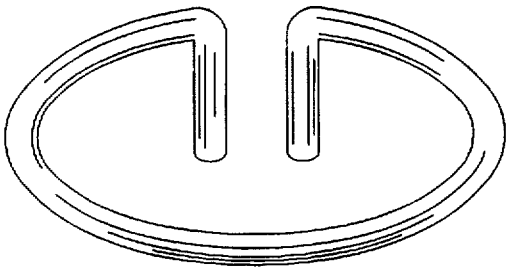
Figure 4D:
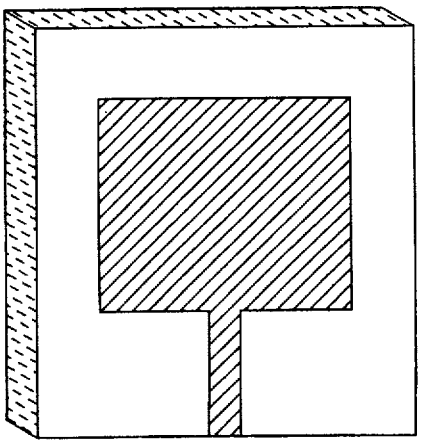

While the antenna elements 40, 42 of the preferred embodiment are monopole elements (FIG 4*a*), other radiating elements can be used as well. Any broad beamwidth element type such as dipoles (FIG 4*b*), both wire and printed microstrip types, loop (FIG 4*c*) antennas and various microstrip patch antennas (FIG. 4*a*) can be readily substituted for the monopole of the present preferred embodiment. The number of elements, likewise, need not be restricted to two as is the case of the preferred embodiment. More than two elements may be used to either increase angular coverage or to resolve phase ambiguities or both. More than two elements can also be used to improve the potential accuracy of the AOA measurement. For instance, if the top and bottom plates are made circular and three to five elements are used, a horned interferometer antenna providing 360 degrees of azimuthal coverage can be constructed with approximately the same AOA accuracy capability as the two element, 140 degrees azimuthal coverage embodiment illustrated in FIGS. 2–4.

Elements such as monopoles and dipoles are inherently linearly polarized. A horned interferometer antenna 12 as depicted in FIGS. 2–4 with a vertically oriented monopole is, in turn, vertically polarized. The horned interferometer antenna 12 of the present invention can be made to accommodate reception of other than vertically polarized signals by use of a polarizing grid or screen. A polarizing grid or screen is an anisotropic transmission medium that differentially affects orthogonal vector components of a wave passing through the media in such a way that an incident wave's polarization is modified in a controlled manner. A well-known type of polarization screen, also called a polarizer, is a meander line polarizer that is comprised of a number of meandering, thin metal conductors supported by a dielectric sheet. The meandering lines can be designed to cause the polarization of an incident wave to be changed to a vertical polarization thereby matching the polarization of the horned interferometer antenna. The meander line polarizer can be designed to transform a circularly polarized wave or a slant 45 degrees linearly polarized wave into the required vertical polarization. The meander line polarizer, once designed and constructed, takes the form of a multi-layer dielectric/meander line sheet or screen. Such a screen can be constructed and placed in the aperture region of the horned interferometer antenna to achieve other than vertical polarization. As an added benefit to polarization transformation, the polarizer can also function as a radome cover for the aperture protecting the antenna elements from adverse environmental conditions.

One theory for the beneficial effects of the tapered flanges holds that EM waves incident on the horned interferometer antenna are gradually transitioned from free space, plane wave propagation to propagating as a transverse electromagnetic (TEM) wave between the top and bottom waveguide plates of the horned interferometer antenna by the action of tapered flanges on the periphery of the top and bottom plates. The TEM wave propagating in the parallel waveguide structure ultimately encounters the antenna elements and induces electric currents on these elements. The induced currents, in turn, produce a propagating wave in the transmission lines that are connected to the antenna elements. The propagating wave is defined as having been received by the homed interferometer antenna when the induced propagating wave exits the ports of the antenna elements.

An alternative theory for the beneficial effects of the flared or tapered region of the plates is that the flared plates provide a smooth transition from the impedance of free space (377 ohms) to that of the parallel plate waveguide. The tapered region of the plates from the outer rim of the plates to the inner portion increases the power density of the electromagnetic wave as transitions into the parallel plate waveguide region.

Figure 9:
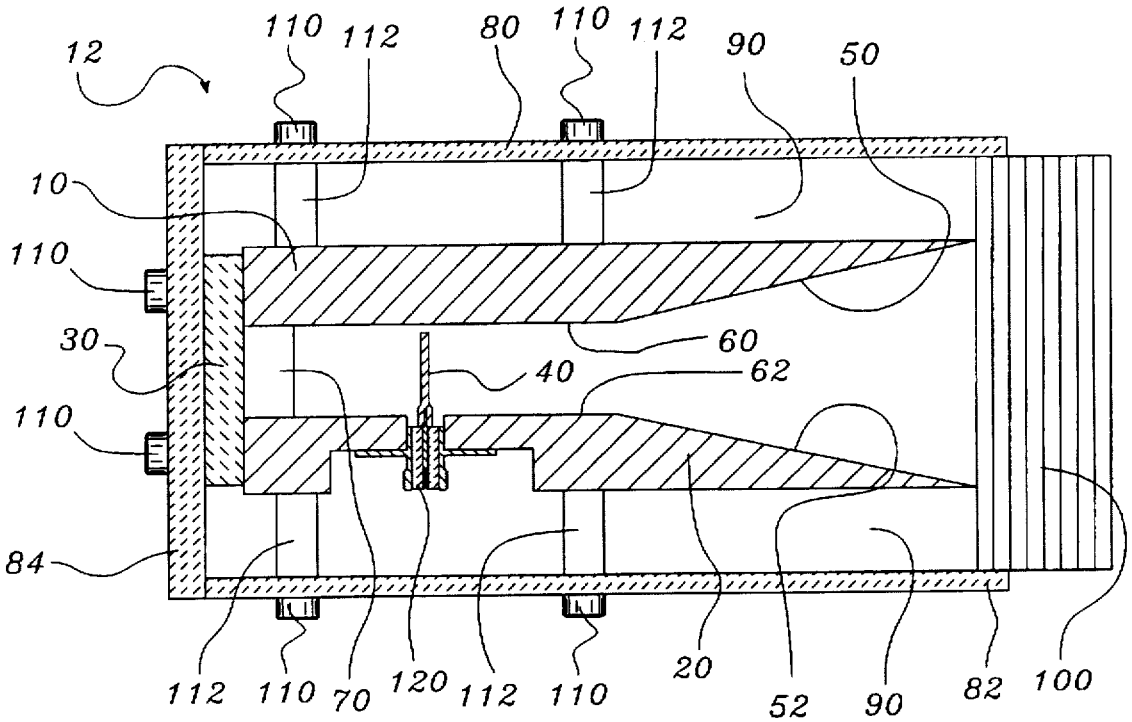
FIG. 9 illustrates in vertical cross-section in a plane bisecting the pair of antenna elements the horned interferometer antenna according to the present invention including a polarizer and antenna housing.
Figure 10:
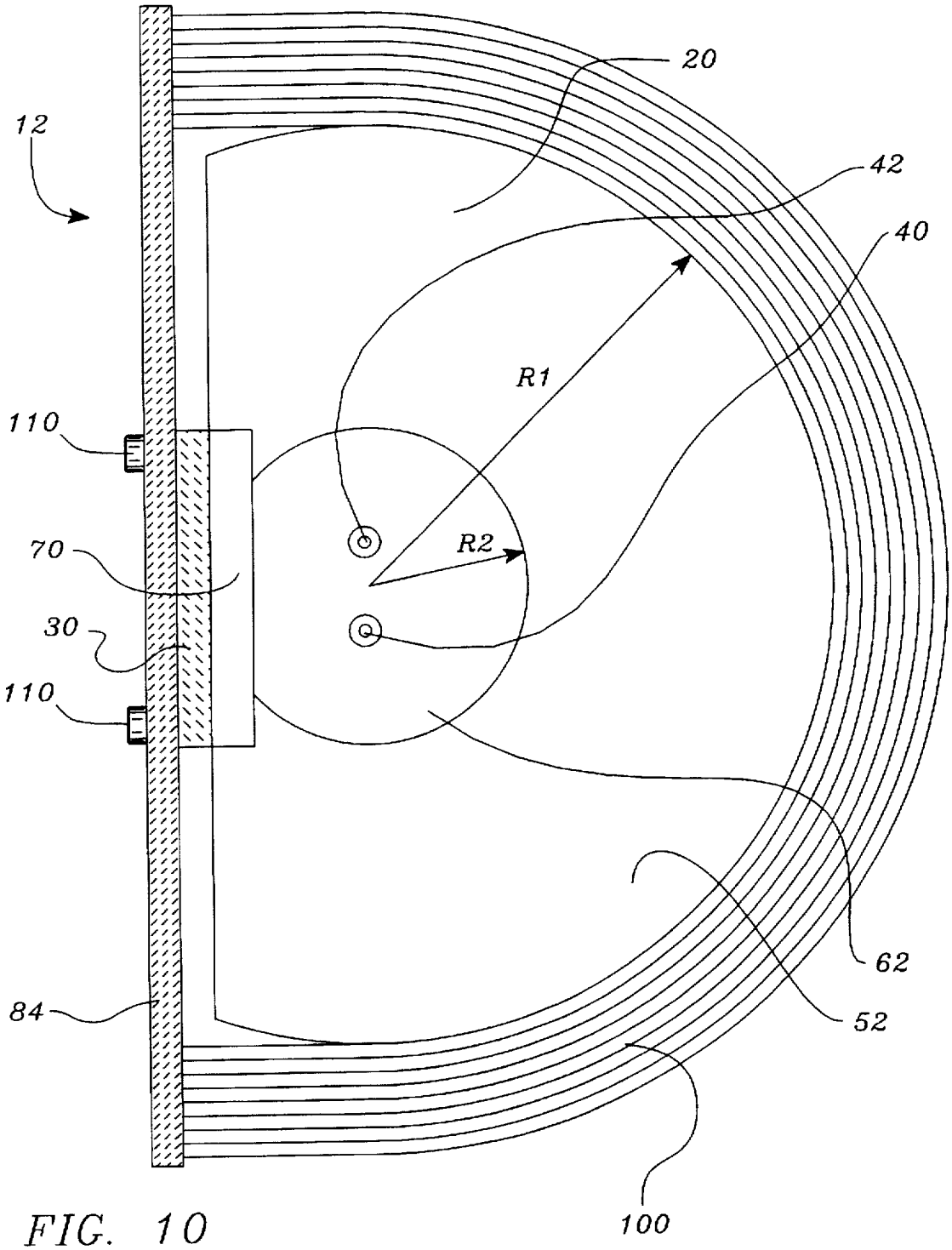
FIG. 10 illustrates in a horizontal cross-section through a plane between the top and bottom plates of the horned interferometer antenna according to the present invention including a polarizer and antenna housing.

Three prototypes of the horned interferometer antenna 12 of the present invention covering the 0.4–2 GHz, 2–6 GHz and 6–18 GHz frequency ranges were constructed and tested. FIGS. 9 and 10 illustrates, by way of example, each of the prototypes. The first prototype was designed to operate in the 6–18 GHz frequency range. The top and bottom plates 10, 20 were machined out of 0.53 inch thick aluminum. The plates 10, 20 had an overall radius of 3.5 inches labeled R1 in FIG. 10. The radius of the untapered regions 60, 62 of the top and bottom plates 10, 20, labeled R2 in FIG. 10, was 1.5 inches. The separator 30 was constructed from aluminum and spaced the top and bottom plates 10, 20 approximately 0.5 inches apart which is equivalent to ½ wavelength at 11.8 GHz. A microwave absorber 70 that was included and was made from commercially available material, model number AN-77, manufactured by Emerson and Cummings of Canton, Mass. The microwave absorber 70 was attached to the front surface of the separator 30 and had a thickness of approximately 0.5 inches. A pair of coaxially fed monopole elements 40, 42 machined from brass with a diameter of 0.050 inches were connected to the center pins of a pair of commercially available 50 ohm coaxial feed-throughs 120 illustrated in FIG. 9. The feed throughs 120 were inserted through holes in the bottom plate approximately 0.168 inches on either side of the center line of the bottom plate and 1.5 inches in front of the separator 30. A pair of coaxial cables (not shown) was used to connect the feed throughs to coax connectors (not shown) mounted on a rear housing plate 84. The coax connectors served as the antenna ports for the multi-port antenna assembly referred to herein as the horned interferometer antenna. The length of the monopoles in the 6–18 GHz prototype was about 0.48 inches that provided good performance over the 6–18 GHz frequency range. The aperture dimension A of this prototype horned interferometer antenna was 1.56 inches.

Alternate absorber materials 70 can be used in place of the specified AN-77 provided they have similar characteristics. The monopole elements 40, 42 can be constructed from the center conductor of a coax cable or can have shapes that vary from the 0.05 in diameter configuration of the preferred embodiment described hereinabove. The choice of the shape and construction of the monopole elements 40, 42 affects, among other things, the bandwidth of the interferometer. Flared monopoles and monopoles with larger diameters than 0.05 inches are known in the art to provide greater bandwidth than those use in the preferred embodiment and are considered applicable to the present invention.

FIGS. 9 and 10 illustrate the present invention as practiced in the constructed prototype. In addition to the basic horned interferometer antenna 12, the prototype included a polarizing screen 100 for adapting the antenna for slant linear polarization and a housing 80, 82, 84 to protect the antenna assembly and to provide a means for mounting the antenna assembly. The housing comprised a non-conductive top 80, bottom 82 and back 84 portions. The horned interferometer antenna 12 was mounted in the housing 80, 82, 84 using eight standoffs 112 through which passed bolts 110 rigidly connecting the housing top 80 and bottom 82 to the horned interferometer antenna 12. In addition, four bolts 110 were used to connect the back of the housing to the separator 30 and the top and bottom plates 10, 20 of the horned interferometer antenna 12. The microwave absorbing material 90, model number AN-77, was placed in the space between the horned interferometer antenna 12 and the housing top and bottom 80, 82. The polarizing screen assembly 100 comprised nine meander line layers each separated by a 0.19 inch thick fiberglass honeycomb and sandwiched together to form the polarizer. The overall thickness of the polarizer 100 was approximately 1.9 inches. The spacing between the housing top 80 and the housing bottom 82 was arbitrarily chosen to be 4 inches to insure that the polarizer height at its front edge was more than the subtended angular extent of the tapered flanges 50, 52 of the top and bottom plates 10, 20 of the horned interferometer antenna.

The 2–6 GHz prototype of the horned interferometer antenna of the present invention was constructed and assembled from the same elements as used for the 6–18 GHz prototype. The dimensions of the component parts were scaled to produce an operational unit in the 2–6 GHz frequency range. In the 2–6 GHz prototype, the plates 10, 20 were machined from 1 inch thick aluminum. The overall radius R1 for this prototype was 4.75inches while the untapered region 60, 62 radius R2 was 2.0 inches. The minimum spacing between the plates 10, 20 in the untapered regions 60, 62 was approximately 1.5 inches and the monopole 40, 42 length was approximately 1.48 inches. The 0.05 inch diameter monopoles 40, 42 were mounted 0.475 inches on either side of the unit center line and approximately 2.0 inches in front of the separator 30. A piece of 1.5 inch thick commercially available microwave absorber 70 model number AN-77 was affixed to the front surface of the separator 30 between the separator 30 and the monopoles 40, 42. The spacing between the housing top 80 and the housing bottom 82 was 7.0 inches and the polarizer 100 was approximately 1.85 inches thick. The 0.4–2 GHz prototype unit was similar in construction to the above mentioned prototypes except the top and bottom plates 10, 20 were made from electroplated fiberglass.

All of the prototype units exhibited positive directivity (directivity greater than 0 dB) at all azimuth angles in the front half hemisphere as well as good voltage standing wave ratio (VSWR) and phase profile performance. The present two antenna element example is intended to provide a 140 degree angular coverage in azimuth (+/–70 degrees on either side of the center line of the top and bottom plates 10, 20).

Figure 11:
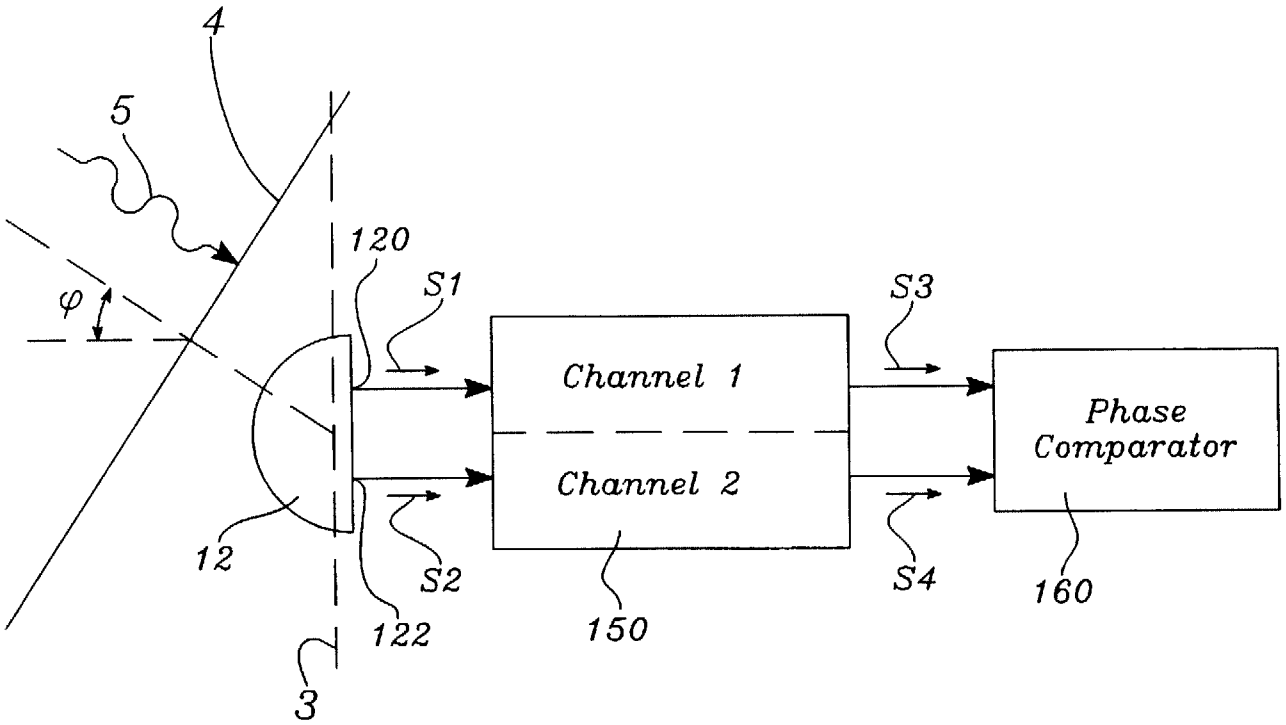
FIG. 11 illustrates a block diagram of a typical interferometer system employing the horned interferometer antenna of the present invention

The horned interferometer antenna 12 of the present invention is used in a multi-channel interferometer system to measure the angle of arrival of an incident electromagnetic wave or signal based on the phase difference between the signal as received by the antenna elements. An example of a two channel interferometer system that utilizes the horned interferometer antenna 12 of the present invention is illustrated in a block diagram in FIG. 11. The interferometer system of FIG. 11 comprises a horned interferometer antenna 12, a multi-channel receiver 150 and a phase comparator 160. In the illustrated example of FIG. 11 the homed antenna 12 has two antenna elements 40, 42 therefore the multi-channel receiver 150 has two channels and the phase comparator 160 has two inputs. For the present invention, the number of antenna elements equals the number of receiver 150 channels and the number of phase comparator 160 inputs. An electromagnetic wave incident on the interferometer system is represented in FIG. 11 by a wavy line 5. The wavefront 4 of the incident electromagnetic wave 5 makes an angle $\phi$ relative to a perpendicular of a baseline 3. The baseline 3, is a line that connects the elements 40, 42 of the horned interferometer antenna 12.

The signals received by the horned interferometer antenna 12 elements 40, 42 exit the antenna 12 through the antenna's output ports 120 and 122 as signals S1 and $2. Each port 120, 122 is connected to the input of a separate receiver channel. The two receiver channels, channel 1 and channel 2, in the multi-channel receiver 150, downconvert the received signals S1 and S2 to a set of a lower frequency intermediate frequency signals S3 and S4. The channels of the multi-channel receiver are phase matched or at least well characterized in terms of their phase performance to avoid the introduction of phase difference between the signals S3 and S4 that are not due to the angle of arrival.

The signals S3 and S4 exit the receiver 150 and enter the phase comparator 160 where the difference in their phases, $\Delta\psi$, is measured. Once the phase comparator 160 has determined the phase difference, $\Delta\psi$, between S3 and S4, the angle of arrival of the incident electromagnetic wave is calculated. Equation (1) or a similar equation that includes calibration terms to account for known errors in the phase difference introduced by the phase comparator 160 and the multi-channel receiver 150 can be used in the calculation of angle of arrival.

Thus there has been disclosed an apparatus 12 that functions as an interferometer antenna with improved directivity when compared to conventional, monopole based interferometers. Changes and modifications may be made to the invention which may be readily apparent to those skilled in the art without going beyond the intended scope of the invention, as defined by the appended claims.

What is claimed is:

1. A horned interferometer system for measuring the angle of arrival of an electromagnetic signal comprising:

a horned interferometer antenna having a plurality of antenna elements disposed between two parallel plates, each of the parallel plates having a free edge that diverges from the other free edge to define an aperture, the aperture for guiding an incident electromagnetic signal to the plurality of antenna elements;

means for receiving signals from the horned interferometer antenna, the means for receiving having a receiver channel for receiving and processing a signal from each element of the plurality of antenna elements, the receiver channels each generating an output signal; and means for comparing phase difference between the output signals of each of the receiver channels.

2. The horned interferometer system of claim 1, wherein the parallel plates of the homed interferometer antenna comprise:

a top plate having a semi-circular shape; and a bottom plate having a semi-circular shape and being spaced apart from the top plate, and wherein the horned interferometer antenna further comprises:

a separator for separating the top plate and the bottom plate and for rigidly connecting the top plate and the bottom plate together.

3. The horned interferometer system of claim 1, wherein the separator is located adjacent the plurality of antenna elements between the top plate and the bottom plate.

4. The horned interferometer system as in claim 1, wherein the free edge diverges in a linear function.

5. The horned interferometer system as in claim 1, wherein the free edge diverges in a nonlinear function.

6. The horned interferometer system as in claim 1, further comprising a radio frequency (RF) signal absorbing layer disposed between the separator and the plurality of antenna elements.

7. The horned interferometer system as in claim 1, further comprising a polarizer located in the aperture near the free edges of the top plate and the bottom plate.

8. The horned interferometer system of claim 1, wherein the plurality of antenna elements comprises a plurality of monopoles.

9. The horned interferometer system of claim 1 wherein the plurality of antenna elements comprises a plurality of dipoles.

10. The horned interferometer system of claim 1 wherein the plurality of antenna elements comprises a plurality of loop antennas.

11. The horned interferometer system of claim 1 wherein the plurality of antenna elements comprises a plurality of microstrip patch antennas.

* * * * *